US006273790B1

(12) United States Patent
Neese et al.

(10) Patent No.: US 6,273,790 B1
(45) Date of Patent: Aug. 14, 2001

(54) METHOD AND APPARATUS FOR REMOVING COATINGS AND OXIDES FROM SUBSTRATES

(75) Inventors: Edward D. Neese, Sewickley; Peter S. Kullen, Penn Hills, both of PA (US); Eugene Valentine, Massilon, OH (US)

(73) Assignee: International Processing Systems, Inc., Sewickley, PA (US)

( * ) Notice: Subject to any disclaimer, the term of this patent is extended or adjusted under 35 U.S.C. 154(b) by 0 days.

(21) Appl. No.: 09/455,139

(22) Filed: Dec. 6, 1999

Related U.S. Application Data

(60) Provisional application No. 60/111,204, filed on Dec. 7, 1998.

(51) Int. Cl.[7] ..... B24B 1/00; B24C 1/00

(52) U.S. Cl. ..... 451/38; 451/39; 451/91

(58) Field of Search ..... 451/28, 36, 38, 451/39, 91, 75, 99, 102; 239/590; 29/81.08, 81.07; 134/2, 15, 41, 34, 18, 28, 32

(56) References Cited

U.S. PATENT DOCUMENTS 392,082 10/1888 Turner .

585,513 6/1897 Desmond .

(List continued on next page.)

FOREIGN PATENT DOCUMENTS

59153513 * 9/1984 (JP) .

*Primary Examiner*—Derris H. Banks
(74) *Attorney, Agent, or Firm*—Webb Ziesenheim Logsdon Orkin & Hanson, P.C.

(57) ABSTRACT

A method and apparatus for removing coatings and oxides from substrates that includes a conveyor for moving a substrate in a first direction, at least one nozzle positioned away from the conveyor in position to direct the stream of fluid toward the conveyor and a high pressure fluid supply in fluid commination with the nozzle wherein the pressurized fluid supply is arranged to supply a pressurized fluid to exit the nozzle and direct the fluid at a high velocity to a surface of the substrate for removing a liquid or solid film from the substrate. The method includes providing a pressurized fluid to a stationary nozzle, directing the pressurized fluid from the nozzle in a high velocity fluid stream toward a moving object having a coating and contacting the fluid stream with the object whereby a force of the fluid removes the coating.

29 Claims, 2 Drawing Sheets

U.S. PATENT DOCUMENTS

| | | | |
|---|---|---|---|
| 608,382 | 8/1898 | McMurtry . | |
| 638,829 | 12/1899 | Woolsey . | |
| 686,208 | 11/1901 | Coyan . | |
| 1,080,059 | 12/1913 | Hatfield et al. . | |
| 1,202,368 | 10/1916 | Cutter . | |
| 1,804,735 | 5/1931 | Barnes et al. . | |
| 1,859,359 | 5/1932 | Fisk . | |
| 1,874,080 | 8/1932 | Brislin . | |
| 1,884,791 | 10/1932 | McCrery . | |
| 1,898,809 | 2/1933 | Berg . | |
| 1,974,571 | 9/1934 | Kiefer . | |
| 2,239,044 | 4/1941 | Leighton | 205/8 |
| 2,289,967 | 7/1942 | Johnson et al. | 29/81 |
| 2,357,695 | 9/1944 | Skowron | 29/81 |
| 2,394,514 | 2/1946 | Evans et al. | 29/81 |
| 2,614,316 | 10/1952 | Daily et al. | 29/81 |
| 2,622,047 | 12/1952 | Ayers | 134/7 |
| 2,711,660 | 6/1955 | Friedman | 80/1 |
| 2,790,230 | 4/1957 | Sobek | 29/81 |
| 2,867,893 | 1/1959 | Andresen et al. | 29/81 |
| 2,900,703 | 8/1959 | Kane | 29/81 |
| 2,961,741 | 11/1960 | Cizek | 29/81 |
| 3,440,082 | 4/1969 | Kube | 117/49 |
| 3,510,065 | 5/1970 | Gigantino et al. | 239/590 |
| 3,511,250 | 5/1970 | Gallucci et al. | 134/122 |
| 3,518,736 | 7/1970 | Domeika | 29/81 |
| 3,696,565 * | 10/1972 | Claeys | 451/39 |
| 4,269,052 | 5/1981 | Imai et al. | 72/39 |
| 4,497,664 | 2/1985 | Verry | 134/22.12 |
| 4,854,091 * | 8/1989 | Hashish et al. | 451/38 |
| 5,025,597 * | 6/1991 | Tada et al. | 451/39 |
| 5,036,689 | 8/1991 | Sekiya et al. | 72/39 |
| 5,272,798 | 12/1993 | Cole et al. | 29/81.08 |
| 5,417,608 * | 5/1995 | Elliott | 451/39 |
| 5,445,553 * | 8/1995 | Cryer et al. | 451/40 |
| 5,525,093 * | 6/1996 | Palmer, Jr. | 451/40 |
| 5,554,235 | 9/1996 | Noe et al. | 148/610 |
| 5,561,884 | 10/1996 | Nijland et al. | 15/321 |
| 5,571,335 * | 11/1996 | Llyod | 451/39 |
| 5,675,880 | 10/1997 | Saikin | 29/81.08 |
| 5,700,181 * | 12/1997 | Hashish et al. | 451/40 |
| 5,759,086 * | 6/1998 | Klingel | 451/38 |
| 5,766,061 * | 6/1998 | Bowers | 451/39 |
| 5,944,581 * | 8/1999 | Goenka | 451/40 |

* cited by examiner

METHOD AND APPARATUS FOR REMOVING COATINGS AND OXIDES FROM SUBSTRATES

CROSS REFERENCE TO RELATED APPLICATIONS

This application claims the benefit of U.S. Provisional Patent Application Ser. No. 60/111,204, filed Dec. 7, 1998 entitled "METHOD AND APPARATUS FOR REMOVING COATINGS FROM SUBSTRATES".

BACKGROUND OF THE INVENTION

1. Field of the Invention

The present invention relates to cleaning of materials or parts using pressurized water where the nozzle or banks of nozzles are fixed with respect to a moving target or product.

2. Description of the Prior Art

Surface cleanliness, a key parameter in materials processing and manufacturing, significantly affects the quality of a product. Cleaning in the manufacturing environment has traditionally been carried out by many methods, but these generally break down into two categories: chemical and mechanical. Chemical methods have been popular in many industries, especially heavy industries, such as primary metals production, because of the thoroughness of the cleaning, high quality, high productivity and the low cost. Typical chemicals used in such cleaning processes are: water, acids, soaps, chlorofluorocarbon (CFC's), chlorinated hydrocarbons, aromatic hydrocarbons, and aliphatic hydrocarbons. Mechanical processes are typically used where the required surface quality is lower, or chemical processes are less convenient or less effective. Typical mechanical cleaning methods are: grit blasting, shot blasting, grinding, brushing and milling. The use of pressurized water for cleaning is a hybrid of the chemical process and the mechanical process. Specifically, water is in-itself a solvent and when sprayed at high pressures, it acts as an abrasive.

The chemical cleaning methods, while still quite popular, have been waning due to environmental and health concerns. The Clean Air Act Amendments of 1990, as well as other environmental legislation, have reduced the usage of some of the most effective chemicals, such as the volatile organic compounds (VOC's) and phosphate based detergents. The effect has been to send industry looking for the best alternative technologies. Currently used chemical cleaning methods, such as acid pickling of steel, tend to generate a vast quantity of waste that must be disposed of or recycled. And so, the advantages of superior quality and high productivity for chemical methods may soon be lost due to the overwhelming costs of environmental control and waste disposal.

Pressurized water has been used in hot metal production lines. Specifically, during reheating of steel slabs and ingots for hot rolling, the metal reacts with the oxygen in the air to form a thick oxide scale. The scale, formed prior to hot rolling, is referred to as "primary scale". This flaky, porous scale is relatively thick and friable. Typically, it is 0.040–0.050 inches thick. Primary scale is removed prior to hot rolling by a pressurized water descaler operating at pressures less than 3500 psi. The water exits the nozzles in a fan fashion. The nozzles are positioned at a distance, on the order of 6–12 inches, from the surface of the metal. Dispensed water contacts the primary scale, which tends to be somewhat exfoliated, and lifts it away from the metal. Water is also trapped in porous pockets in the scale. At these temperatures, on the order of 1600 degrees Fahrenheit, steam forms quickly and the scale is also dislodged by the rapidly expanding steam.

During cooling of the hot rolled steel, the oxygen in the air again reacts with the metal to form a much thinner and tighter oxide coating. This is referred to as "secondary" scale or post hot rolling scale. The secondary scale is on the order of 0.005 inches thick or less and is dense and uniform in nature. The above-described pressurized water system cannot remove the secondary scale. Therefore, abrasion and/or chemical methods such as pickling must be used. Pressurized water, i.e., water maintained at pressure above 20,000 psi (pounds per square inch) has been used for 10–20 years in applications, such as rock drilling, stripping paint from bridges, metal cutting, cutting of fiber glass circuit boards, and cutting of lumber. More recently, pressurized water has been adapted to more refined applications, such as robotic stripping of paint from airplanes and ships, cleaning electronic circuit boards, CNC machining, cleaning and near net shape machining of metal and ceramic parts. In all these instances the work piece is held stationary and the nozzle, which supplies the high pressure water stream, moves relative to the target.

Work has been carried out by Dr. David Summers at the University of Missouri to develop efficient nozzles for hand-held wands. These hand-held systems have been used at pressures up to 60,000 psi and a flow rate of 1–2 gpm (gallons per minute). Work has also been carried out by the NASA Marshal Space Flight Center (MSFC) where ultra high pressure water has been adopted to robotically move the high pressure nozzle over a stationary object (a reusable rocket booster) to remove left over fuel. Similarly, the Air Force has been testing a robotic system to remove paint from airplanes. MSFC has also been experimenting with the injection of a solid abrasive into the high pressure stream to increase the efficiency of the process. The abrasive currently used is made of baking soda (sodium bicarbonate) and the process leaves solids that must be disposed of. A problem with abrasive type system is that the abrasive must be disposed of offsite. This is a costly endeavor.

It is an object of the present invention to provide an improved cleaning method for materials processing with increased productivity.

It is further an object of the present invention to provide a substrate cleaning method that is faster than the prior state of the art, results in a more uniform surface quality than the prior state of the art and minimizes waste.

SUMMARY OF THE INVENTION

One aspect of the present invention utilizes a high pressure slurry of ice and water directed toward a moving substrate to clean a surface of the substrate. The present invention omits the use of chemicals, thereby significantly reducing the risk to the environment. Further, the present invention provides various advantages over traditional chemical cleaning methods, such as simplification of the process, improvement in efficiency, improved surface quality, improvement of the work environment and reduced energy costs. The present invention provides an advantage over current high pressure cleaning systems utilizing solid abrasive injection by using ice particles in the cleaning fluid as the abrasive. Furthermore, the present invention eliminates the need to dispose of or recycle the leftover solids of the chemical cleaning solution. The prior art systems include leftover solids are often mixed with hazardous waste and, subsequently, must be treated as a hazardous waste.

Another aspect of the present invention is a pressurized water cleaning method for materials processing and manufacturing, that includes the steps of:

(a) conveying or moving a product having a surface through a set of fixed nozzles or spray headers; and (b) directing a pressurized stream of cleaning fluid toward the surface of the product. Preferably, the cleaning fluid is water. The stream may include ice particles. Preferably, the pressurized stream is in the range of 10,000 psi (pounds per square inch) to 120,000 psi. By pressurized stream it is meant that the supply of pressurized liquid to a nozzle prior to the liquid exiting the nozzle in a stream at approximately atmospheric pressure.

The moving product may be in the form of a strip, sheet, rod, wire, bar or filament. The materials may be carbon steel, stainless steel, titanium, brass, copper, bronze, Inconel, aluminum, glass, kevlar, polymer, fiberglass, or foam. Essentially, the process may be used on all materials and materials systems where the surface layers are required to be removed. This could apply to oils and greases on any substrate, surface oxides on metallic substrates, and protective coatings on metals, paints, polymers or ceramics. Generally, the present invention can be used where an undesirable coating or film, solid or liquid, needs to be removed from a substrate.

The present invention is also an arrangement for cleaning materials that includes a conveyor for transporting a product or target material having a surface and a set of nozzles or spray header positioned to direct a high pressure stream of cleaning fluid toward the product surface as the product is positioned on the conveyor. Preferably, the product travels at a speed of ten (10) feet per minute (fpm) to five hundred (500) feet per minute (fpm). Preferably, the cleaning fluid flows at a volumetric flow rate of one (1) gallon per minute to fifty (50) gallons per minute per nozzle and more preferably one gallon per minute to twenty (20) gallons per minute. A set of spray headers are positioned above and below the target material or product to clean the respective surfaces. The spray headers are configured to direct pressurized cleaning fluid onto the surface of the product. A nozzle or a set of nozzles are coupled to the spray headers to deliver a stream of pressurized cleaning fluid towards the respective surfaces. The nozzles may be single or multiple orifice nozzles and may supply a cylindrical stream or a fanned stream of cleaning fluid. The nozzles may be fixed, but preferably the nozzles rotate about a longitudinal axis of the nozzle.

A refrigeration system may be provided to generate small ice particles in the cleaning fluid prior to exiting the spray headers. The ice particles in combination with water exiting the nozzle form an ice water mixture where the ice acts as an abrasive when it contacts the product surface. Preferably, ice is injected into the cleaning fluid when necessary.

A fluid pump is in fluid communication with the spray headers to supply ultra high pressure cleaning fluid to the headers. The pressures supplied by the pump may be in the range of 10,000 psi to 120,000 psi. Preferably, the flow rate generated by the pump may be between one (1) and fifty (50) gpm and the spray headers have a maximum width of eighty (80) inches. The conveyance speeds may range from ten (10) feet per minute (fpm) to five hundred (500) fpm.

The present invention is believed to be particularly well suited to clean oxides, especially secondary scale, from metal substrates, such as steel, copper alloys, aluminum, and titanium alloys. It is also believed to be well suited to remove protective coatings such as paint or zinc from a coiled substrate. The present invention is applicable for cleaning any type of films, such as grease or paint from metal or nonmetallic substrates.

More specifically, the present invention is a material cleaning system that includes a conveyor for moving a substrate in a first direction and at least one nozzle positioned away from the substrate. A pressurized fluid supply is in fluid communication with the nozzle. The nozzle is arranged so that the pressurized fluid exits the nozzle and is directed to a surface of the substrate for removing a liquid or a solid film from the substrate. Preferably, the pressure of the fluid prior to exiting the nozzle is on the order of 10,000 psi to 120,000 psi and, more preferably, 40,000 psi to 60,000 psi. Preferably, a plurality of nozzles are provided with a header and arranged over the conveying arrangement. Preferably, a reel system is used to convey the substrate in close proximity to the nozzles. Alternatively, any type of conveying system may be used, for example, rotary tables, rotating spindles, reel-to-reel take up, etc. The pressurized fluid is accomplished through a crank type pump, a piston pump, or any other pump capable of generating the necessary pressures and volumes.

In another embodiment of the present invention, a pressurized mixture of ice and water can be provided to the nozzles. A high velocity stream of the mixture contacts a surface of the substrate, thus removing a film coating on the substrate.

The present invention is also a method for removing a coating on a substrate that includes the steps of:

(a) providing a pressurized fluid to a stationary nozzle, which may be multi-ported and rotate or oscillate about an axis;

(b) directing the pressurized fluid from the nozzle in a high velocity fluid stream towards a moving object having a surface coating; and (c) contacting the fluid stream with the object, whereby a force of the fluid removes the coating. Preferably, the fluid is water. More preferably, the fluid is a mixture that includes an abrasive. Most preferably, the mixture is made up of ice and water.

DESCRIPTION OF THE PREFERRED EMBODIMENTS

Figure 1:
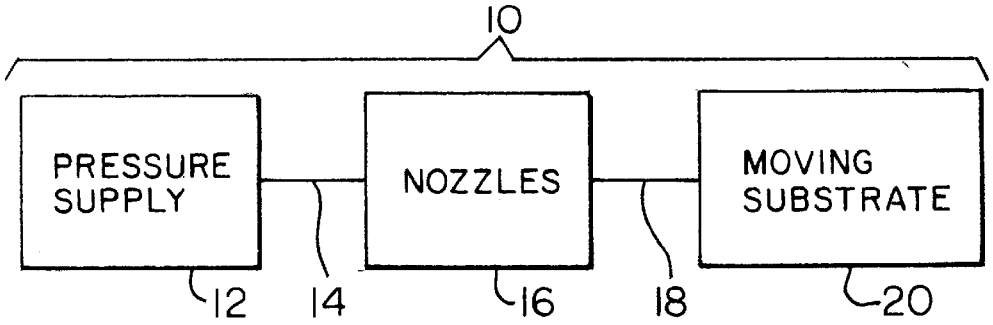
FIG. 1 is a schematic view of a cleaning system made in accordance with the present invention.

FIG. 1 is a schematic showing a cleaning system 10 made in accordance with the present invention. Specifically, the cleaning system 10 includes a pressurized supply of water 12 in fluid communication with a conduit 14. The conduit 14 is in fluid communication with a plurality of nozzles 16. The nozzles 16 are arranged so that the pressurized fluid (preferably water) exits the nozzles in a high velocity stream 18 to contact a substrate 20 having a coating, such as an oxide coating or grease coating on a substrate of metal or non-metallic material, such as plastic.

Figure 2:
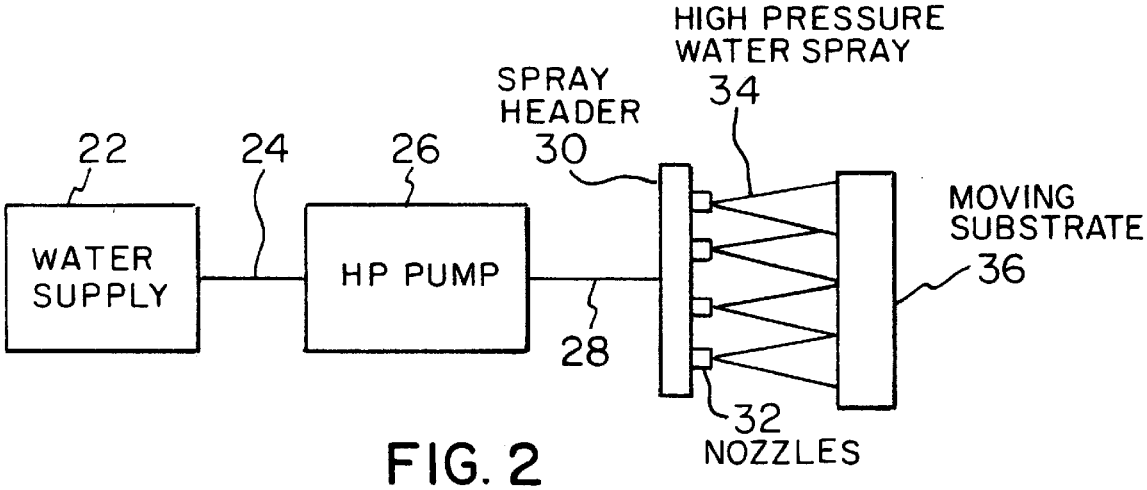
FIG. 2 is a schematic view of the cleaning system shown in FIG. 1 in more detail.

FIG. 2 shows the cleaning system shown in FIG. 1 in more detail. A water supply 22 is in fluid communication with a conduit 24. The conduit 24 is in fluid communication with a high pressure (HP) pump 26. The high pressure pump 26 is in fluid communication with a conduit 28. The conduit 28 is in fluid communication with a spray header 30 containing a plurality of nozzles 32. The nozzles are arranged so that the pressurized fluid exits the nozzles at a high velocity stream 34 to contact a moving substrate 36 having a coating.

Figure 3:
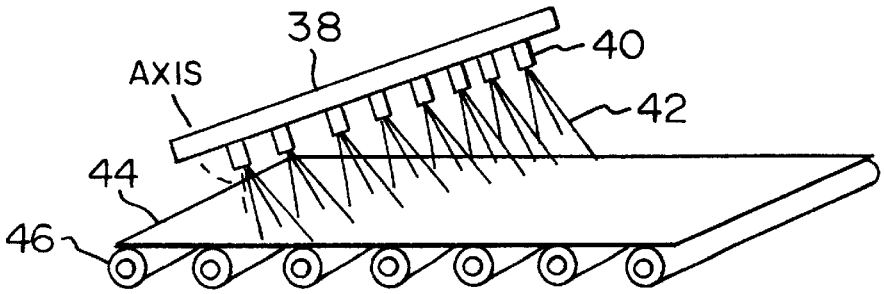
FIG. 3 is a perspective view of the cleaning system schematically shown in FIGS. 1 and 2.

FIG. 3 in accordance with this invention shows a cleaning system spray header 38 with a plurality of nozzles 40 arranged so that the pressurized fluid (preferably water) exits the nozzles as a high velocity stream 42 to contact a substrate 44 that is being moved by a conveying system 46.

Figure 4:
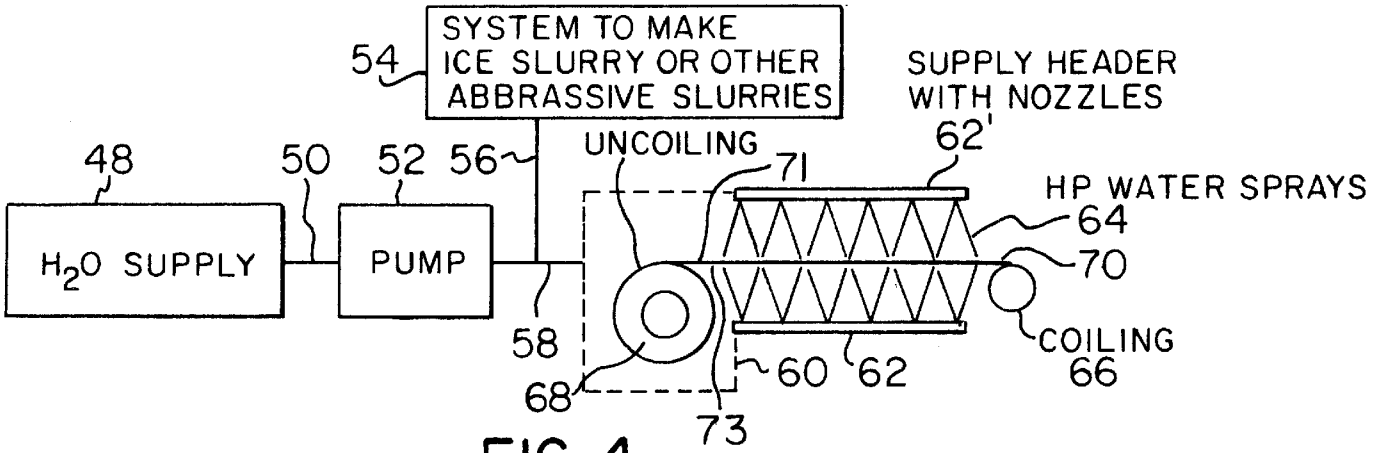
FIG. 4 is a schematic view of another embodiment of the cleaning system shown in FIG. 3.

FIG. 4 shows another embodiment of the present invention and includes a water supply 48 in fluid communication with a conduit 50. The conduit 50 is in fluid communication with a high pressure pump 52, such as the pumps previously described. The pump is in fluid communication with a conduit 58. A system for making an ice slurry or mixture 54 is provided. This system 54 includes a refrigeration unit and a pump, such as a screw pump. The system to make an ice slurry 54 is in fluid communication with the conduit 58, through a conduit 56. The conduit 58 is in fluid communication with a branching conduit 60 having an upper portion and a lower portion. The lower portion of the branching conduit 60 is in fluid communication with a bottom spray header 62 and an upper spray header 62'. The spray headers are provided with a plurality of nozzles for directing the cleaning fluid toward a substrate. A coiler 66 is positioned on one side of the spray headers 62 and 62' and an uncoiler 68 is positioned on another side of the spray headers 62 and 62'. A substrate 70, such as a metal strip, is wound around the coiler 66 and uncoiler 68. The metal strip 70 includes a film, such as grease or oxides, on its outer surfaces 71 and 73. The nozzles of the spray headers 62 and 62' direct the high pressure water with ice mixture toward the metal strip or substrate 70 for removal of the coating. The pressurized water exits as a high velocity stream and then contacts the moving metal strip 70. Contact of the high velocity water and ice mixture causes the coating to be removed.

Figure 5:
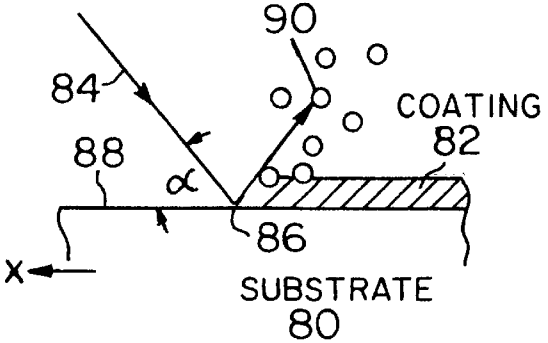
FIG. 5 is an elevational view of a portion of the cleaning system shown in FIG. 3.

FIG. 5 shows the mechanics of the removal of a coating from a substrate in more detail. Specifically, FIG. 5 shows a substrate 80, such as the metal strip 70, shown in FIG. 4, having a coating 82, such as an oxide coating or grease coating. A high velocity fluid stream 84 is directed at the substrate 80 at a contact point 86. The stream 84 contacts the substrate surface 88 at an angle $\alpha$. The substrate 80 travels in a direction X opposite the direction of the liquid stream 84. The liquid stream can be a mixture of ice and water. After the liquid stream 84 contacts the substrate surface 88 and the coating 82, coating particles 90 are carried away by the stream 84, thereby exposing the surface of the base material.

Preferably, water is used as the cleaning solution. The pressures of the water supplied by the pump preferably are in the range of 10,000 psi to 120,000 psi and, more particularly, 40,000 to 60,000 psi. Preferably, the flow rate of the pump may be between one (1) and fifty (50) gallons per minute and more preferably between twelve (12) and twenty (20) gallons per minute. Preferably, the spray headers have a maximum width of 80 inches so that a standard steel strip can be cleaned. The high pressure fluid, i.e., water, can be accomplished through a crank type pump, a piston pump, or any other pump capable of generating the necessary pressures and flow rates. One type of pump that can attain these high pressures is Model D1500-40 manufactured by New Jet Technologies of Seattle, Wash.

An important aspect of the present invention is that the substrate is conveyed by conveyors relative to the nozzles. FIG. 3 shows a plurality of driven rollers 46 as the conveyor. Other types of conveying arrangements can be used, such as a reel system as shown in FIG. 4 or rotary tables, rotating spindles, reel-to-reel take up, etc.

The nozzles for directing the liquid toward the moving substrate are specifically designed for high pressure fluid applications. Nozzles can direct the high pressure fluid in a straight high velocity line or a fanned stream. The nozzles may be fixed to the header or not rotate or they may rotate about a longitudinal axis of the nozzle, as shown in FIG. 3.

The present invention is believed to be well suited to clean oxides from metal substrates, such as steel, copper alloys, aluminum and titanium alloys. It is also believed to be well suited to remove protective coatings, such as paint or zinc from a sheet or a coiled substrate. Furthermore, it is believed that the present invention is well suited for removing greases and other organic coatings on a substrate, such as steel. Also, the present invention is believed to be well suited for the removal of similar coatings on non-metallic material, such as plastic.

Figure 6:
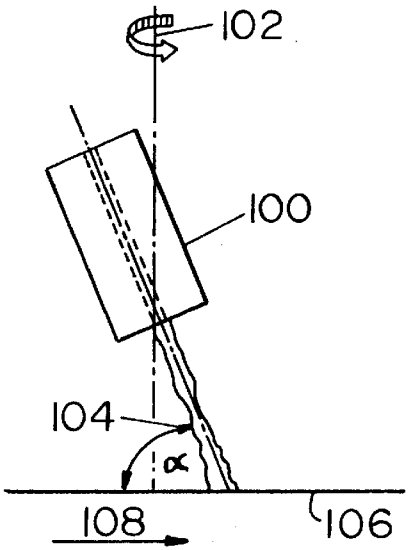
FIG. 6 is an elevational view of a portion of the cleaning system made in accordance with the present invention showing a nozzle, water stream and substrates.

Preferably, the present invention utilizes an intermediate pressure of water or liquid higher. By definition intermediate pressures are 5,000 psi–20,000 psi, very high pressures of water 20,000 psi–60,000 psi, and ultra high pressures at greater than 60,000 psi. The present invention can operate at all of these pressure ranges and preferably 5,000 psi–120,000 psi. Preferably, the present invention is used to remove scale from rolled metal and most preferably secondary scale, which is a metal oxide, although the present invention can also be used to remove primary scale. Preferably, the water exits a rotating or oscillating nozzle as shown in FIG. 6. FIG. 6 shows a nozzle 100 which is in fluid communication with the spray header 62, in a high pressure source of water shown in FIG. 4. The nozzle 100 is adapted to rotate about an axis 102 so that a stream of water 104 contacts an area of a substrate, such as steel, 106 to remove an oxide coating, such as a secondary coating. Preferably, the water pressure supplied to the nozzle is in the range of 5,000–120,000 psi; the angle of attack $\alpha$ as shown in FIG. 6 is between 90° and 75° as measured from the surface of the substrate 106 where the stream of water 104 contacts the substrate 106 or 0°–15° as measured from a vertical axis normal to the surface of the substrate 106 where the stream of water 104 contacts the substrate 106; the volume of water flowing through the nozzle is between 1–20 gallons per minute (GPM), preferably 6–20 gallons per minute (GPM); and the velocity of water exiting the nozzle is on the order of two thousand feet per second or more at a stream diameter between 0.03 inches and 0.065 inches. One such nozzle is provided as the ultra high pressure (UHP) GUN, Model # UPSG-40 manufactured by Underpressure Systems, Inc. in which the stream of water exits at 3,000 feet per second and the pressure of the pressurized water is on the order of 60,000 psi. The substrate moves in the horizontal direction 108 relative to the nozzle 100 and the nozzle rotates about axis 102 relative to the substrate 106. Preferably, the nozzle rotates or oscillates at 50–5,000 RPM (revolutions per minute). Preferably, the nozzle 100 includes a plurality of ports, of which only one is shown in FIGS. 6 and 7, and oscillates or rotates about the axis 102 wherein a high velocity water stream 104 exits from each of the ports, so that each of the fluid streams contact the object, whereby the force of the fluid from each of the fluid streams removes the coating on the substrate 106.

Figure 7:
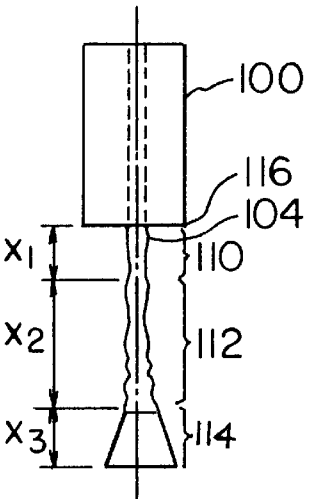
FIG. 7 is an elevational view of a nozzle used in the present invention showing three physical states of water exiting therefrom.

FIG. 7 shows the nozzle 100 having a stream of high velocity water 104. The water stream 104 has three zones: zone one 110 is known as the coherent where the water stream has the highest energy; zone two 112 is known as the unstable zone, where the water stream begins the fade out and lose energy; and zone three 114, the dispersion zone, where the water stream 104 breaks into droplets and has the least amount of energy. In the case of primary scale, the waterdrop forms of zone three 114 will suffice to remove the scale. However, dispersion will not remove secondary scale. Therefore, the nozzle tip 116 must be positioned close to the substrate so that the water stream 104 contacts the substrate in the unstable zone, i.e., metastable zone, or within the coherent zone. Preferably, the nozzle tip 116 is positioned between ½–2 inches away from the substrate surface, which based upon the above-identified parameters, results in a water stream that is either in the coherent zone 110 or unstable zone 112 but not in the dispersion zone 114. The coherent zone occurs within a distance X, from the nozzle tip 116; the unstable zone occurs between a distance $X_1$ and $X_2$ from the nozzle tip 116; and the dispersion zone occurs a distance greater than a distance $X_2$. These distances $X_1$, $X_2$, and $X_3$ are defined by various factors, such as the initial water stream diameter and the supply pressure of the water to the nozzle.

Although the present invention has been described in detail in connection with the discussed embodiments, various modifications may be made by one of ordinary skill in the art without departing from the spirit and scope of the present invention. Therefore, the scope of the present invention should be determined by the attached claims.

What is claimed is:

1. A method for removing a coating on a substrate, comprising the steps of:

(a) providing a pressurized fluid to a stationary nozzle;

(b) directing the pressurized fluid from the nozzle in a high velocity fluid stream toward a moving object having a coating, wherein the velocity of fluid stream is over 1,000 feet per second; and (c) contacting the fluid stream with the object, whereby a force of the fluid removes the coating.

2. The method as claimed in claim 1, wherein the fluid is water.

3. The method as claimed in claim 2, further comprising providing an abrasive with the water prior to exiting the nozzle, so that the exiting high velocity fluid stream includes an abrasive.

4. The method as claimed in claim 3, wherein said abrasive is ice.

5. A method as claimed in claim 1 wherein the object is metal.

6. A method as claimed in claim 1, wherein the coating is scale.

7. A method as claimed in claim 6, wherein the scale is a secondary scale.

8. A method as claimed in claim 1, wherein the coating is an oxide.

9. A method as claimed in claim 1, wherein the stationary nozzle rotates about an axis relative to the object.

10. A method as claimed in claim 1, wherein the high velocity stream exits at an angle $\alpha$ relative to the object.

11. A method as claimed in claim 1, wherein the water stream contacts the object in one of a coherent zone and a metastable zone.

12. A method as claimed in claim 1, wherein the object is rolled metal and the coating is secondary scale, wherein the high pressure fluid is provided in the range of 5,000 psi to 120,000 psi, the velocity stream contacts the object at an angle of 0° to 15° as measured from a vertical axis normal to a surface of the object whereby the velocity stream contacts the object, and the volume of water passing through the nozzle is between one and twenty gpm.

13. A method as claimed in claim 1, wherein the nozzle comprises a plurality of ports and ocillates about an axis, wherein a high velocity fluid stream exits from each of the ports so that each of the fluid streams contact the object whereby the force of the fluid from each of the fluid streams removes the coating.

14. A material cleaning system comprising:

a conveyor for moving a substrate in a first direction;

at least one nozzle positioned away from said conveyor and positioned to direct a stream of fluid toward the conveyor; and a pressurized fluid supply in fluid communication with the nozzle, wherein the pressurized fluid supply is arranged to supply a pressurized fluid to exit the nozzle and direct the fluid at a high velocity of over 1,000 feet per second to a surface of the substrate for removing a liquid or solid film from the substrate.

15. The material cleaning system as claimed in claim 14, wherein the pressurized fluid supply comprises a pump for pressurizing a fluid.

16. The material cleaning system as claimed in claim 15, wherein the pump pressurizes the fluid supply on the order of 5,000 to 120,000 psi.

17. The material cleaning system as claimed in claim 16, wherein the pump pressurizes the fluid supply to a pressure of 40,000 psi to 60,000 psi.

18. The material cleaning system as claimed in claim 14, wherein the conveyor includes one of a rotary table, rotating spindles, and a reel-to-reel take up.

19. The material cleaning system as claimed in claim 14, further comprising a plurality of nozzles attached to a header which is in fluid communication with the high pressure fluid supply.

20. The material cleaning system as claimed in claim 14, further comprising means for supplying ice to the high pressure fluid supply for forming a mixture of ice and fluid to be supplied to the nozzle.

21. A method for removing scale from a rolled metal product comprising the steps of:

(a) providing a pressurized fluid to a stationary nozzle, wherein said fluid comprises water;

(b) directing the pressurized fluid from the nozzle in a high velocity fluid stream toward a moving rolled metal having scale on a surface of the metal, wherein the velocity of the fluid is over 1,000 feet per second; and (c) contacting the fluid stream with the surface, of the metal whereby a force of the fluid removes the scale, wherein the fluid is pressurized to a pressure between 5,000 psi and 120,000 psi.

22. A method as claimed in claim 20, wherein said scale is secondary scale.

23. A method as claimed in claim 20, wherein said scale is scale formed subsequent to the formation of primary scale.

24. A method as claimed in claim 20, wherein said scale is an oxide formed at elevated temperatures.

25. A method for removing secondary scale on rolled metal, comprising the steps of:

(a) providing a high pressure fluid to a stationary nozzle wherein the high pressure fluid is provided in the range of 5,000 psi to 120,000 psi;

(b) directing the high pressure fluid from the nozzle in a high velocity fluid stream toward moving rolled metal having secondary scale; and (c) contacting the fluid stream with the object, whereby a force of the fluid removes the secondary scale, wherein the velocity stream contacts the object at an angle of 0° to 15° as measured from a vertical axis normal to a surface of the rolled metal whereby the velocity stream contacts the rolled metal, and the volume of water passing through the nozzle is between one and twenty gpm.

26. A method for removing a coating on a substrate, comprising the steps of:

(a) providing a pressurized fluid to a stationary nozzle;

(b) directing the pressurized fluid from the nozzle in a high velocity fluid stream toward a moving object having a coating; and (c) contacting the fluid stream with the object, whereby a force of the fluid removes the coating, wherein the nozzle comprises a plurality of ports and ocillates about an axis, wherein a high velocity fluid stream exits from each of the ports so that each of the fluid streams contact the object whereby the force of the fluid from each of the fluid streams removes the coating.

27. A method for removing a coating on a substrate, comprising the steps of:

(a) providing a pressurized fluid to a stationary nozzle;

(b) directing the pressurized fluid at a pressure of over 5,000 psi from the nozzle in a high velocity fluid stream toward a moving object having a coating; and (c) contacting the fluid stream with the object, whereby a force of the fluid removes the coating.

28. A method for removing coating on a substrate as claimed in claim 27, wherein the pressurized fluid is provided at a pressure between on the order of 5,000 psi to 120,000 psi.

29. A material cleaning system comprising:

a conveyor for moving a substrate in a first direction;

at least one nozzle positioned away from said conveyor and positioned to direct a stream of fluid toward the conveyor; and a pressurized fluid supply in fluid communication with the nozzle, wherein the pressurized fluid supply is arranged to supply a pressurized fluid to exit the nozzle and direct the fluid at a high velocity to a surface of the substrate for removing a liquid or solid film from the substrate, wherein the nozzle comprises a plurality of ports and ocillates about an axis, wherein a high velocity fluid stream exits from each of the ports so that each of the fluid streams contact the object whereby the force of the fluid from each of the fluid streams removes the coating.

* * * * *

UNITED STATES PATENT AND TRADEMARK OFFICE

CERTIFICATE OF CORRECTION

PATENT NO. : 6,273,790 B1
DATED : August 14, 2001
INVENTOR(S) : Edward D. Neese et al.

It is certified that error appears in the above-identified patent and that said Letters Patent is hereby corrected as shown below:

Column 1,
Line 60, "0.050 inches" should read -- 0.050 inch --.

Column 2,
Line 8, "0.005 inches" should read -- 0.005 inch --.
Line 32, "left over fuel" should read -- leftover fuel --.
Line 66, after "solids" insert -- which --.

Column 6,
Line 58, "0.03 inches" should read -- 0.03 inch --.
Line 59, "0.065 inches" should read -- 0.065 inch --.

Column 8,
Line 15, "contact" should read -- contact --.
Line 62, "in claim 20" should read -- in claim 21 --.
Line 64, "in claim 20" should read -- in claim 21 --.
Line 66, "in claim 20" should read -- in claim 21 --.

Column 10,
Line 26, "contact the object" should read -- contacts the object --.

Signed and Sealed this

Thirtieth Day of April, 2002

*Attest:*

*Attesting Officer*

JAMES E. ROGAN
*Director of the United States Patent and Trademark Office*